US005996322A

United States Patent [19]

La Barre

[11] Patent Number: 5,996,322

[45] Date of Patent: Dec. 7, 1999

[54] IN-LINE BOTTLING PLANT

[75] Inventor: Paul La Barre, Sainte-Adresse, France

[73] Assignee: Sidel, Le Harve Cedex, France

[21] Appl. No.: 08/913,929

[22] PCT Filed: Mar. 20, 1996

[86] PCT No.: PCT/FR96/00416

§ 371 Date: Feb. 25, 1998

§ 102(e) Date: Feb. 25, 1998

[87] PCT Pub. No.: WO96/29245

PCT Pub. Date: Sep. 26, 1996

[30] Foreign Application Priority Data

Mar. 23, 1995 [FR] France ..... 95 03428

[51] Int. Cl.[6] ..... B65B 3/02; B67C 7/90

[52] U.S. Cl. ..... 53/561; 53/250; 53/284.5; 198/347; 425/526

[58] Field of Search ..... 53/561, 251, 250, 53/253, 271, 273, 272, 283, 282, 284.5, 452; 425/526; 198/347

[56] References Cited

U.S. PATENT DOCUMENTS

| | | | |
|---|---|---|---|
| 4,208,852 | 6/1980 | Pioch | 53/561 X |
| 4,361,759 | 11/1982 | King et al. | 198/347 X |
| 4,635,784 | 1/1987 | Bourgeois | 198/347 |
| 5,453,237 | 9/1995 | Padovani | 53/561 X |

FOREIGN PATENT DOCUMENTS

| | | |
|---|---|---|
| 66119 | 12/1982 | European Pat. Off. . |
| 427683 | 5/1991 | European Pat. Off. . |
| 2122152 | 11/1972 | Germany . |
| 2621993 | 12/1977 | Germany . |
| 2703527 | 8/1978 | Germany . |
| 3823032 | 1/1990 | Germany . |

*Primary Examiner*—James F. Coan
*Attorney, Agent, or Firm*—Sughrue, Mion, Zinn Macpeak & Seas, PLLC

[57] ABSTRACT

An in-line bottling plant essentially comprising a unit (1) for producing containers, particularly bottles, from a thermoplastic material, a unit (2) for filling the containers, and a unit (3) for conveying freshly produced containers, the conveying unit being arranged between an outlet (4) of the container producing unit (1) and an inlet (5) of the container filling unit (2). The container producing unit (1) and filling unit (2) are arranged as close together as possible and the conveying unit (3) is short and conveys the containers one after the other substantially without bumping them, particularly against one another. The in-line bottling plant preferably further comprises a unit (19) for temporarily retaining the containers, which unit is selectively connectable to the conveying unit (3) for receiving and retaining a number of containers.

16 Claims, 3 Drawing Sheets

IN-LINE BOTTLING PLANT

FIELD OF THE INVENTION

The present invention relates to improvements made in the field of in-line bottling plants comprising essentially a unit for manufacturing containers, in particular bottles, made of thermoplastic material, a unit for filling said containers and, interposed between the outlet of said unit for manufacturing the containers and the inlet of said unit for filling the containers, a unit for conveying the containers which have just been manufactured.

RELATED ART

For feeding bottling plants with containers to fill, it is known to manufacture said containers in a manufacturing unit which is geographically remote from the bottling unit, with transport of the containers by is road and/or rail from the manufacturing unit to the manufacturing unit [sic] to the filling unit.

To avoid the difficulties inherent in long-distance transport of the containers from the manufacturing unit to the filling unit, it is also known to instal the manufacturing unit in the vicinity of the filling unit and to transfer the containers from the former to the latter with the aid of a conveying device.

However, it has always been deemed necessary to provide a buffer between the manufacturing unit and the filling unit so as to reduce the effects on one of the units of the momentary stoppage of the other unit as a result of a brief incident. To this end, the conveying device was made in the form of a conveyor of very great developed length, possibly as much as 500 m or even more, which corresponds to a volume of several thousand containers.

Moreover, such a conveying device occupies considerable space. It is therefore doubly costly, in terms of equipment and in surface area occupied, and that much more so the greater the length. It has of course been possible to arrange the conveying device at least in part in an aerial manner in order to free the maximum surface area on the ground but the advantage obtained is minimal.

Furthermore, maintaining a conveying device of such great length in a reliable operational state proves difficult and costly, the difficulty and the cost being that much more expensive where the conveying device is long.

Attempts have of course been made to reduce the length of the conveyor and the surface area occupied by the conveyor device by making compact devices for temporary storage of empty containers, which are managed so as to regulate the flow of containers between the manufacturing unit and the filling unit. However, these storage devices have insufficient storage capacity for the saving on establishing and maintaining the conveying device to be felt to any significant degree. Furthermore, these storage devices are themselves costly to construct and require maintenance so that, ultimately, they have not brought the expected advantages.

Another disadvantage of the conveyors used is the possibility of damage to at least some of the containers transported. This is because, in the plants in question, wide use is made of pneumatic conveyors which bring into play a series of jets of air which act on the container, in particular on the neck of the latter, which is guided between two rails, which container, as it is empty and light, is then propelled at very high speed. The empty container is of course easily deformable and, if it collides with an obstacle (for example, a preceding container which has stopped or been displaced less quickly), it may itself suffer and/or cause the preceding container damage, for example deformation such as an indentation in the shoulder; this may lead to a loss of symmetry of the container which may cause its inclination in relation to the vertical for example and such a unit is no longer suitable for being conveniently gripped in the filling unit, which leads to malfunctioning of the latter.

An unacceptable deformation of the same type may also affect containers transported over great distances between geographically remote units.

It must also be borne in mind that damage to a number of containers leads to a not inconsiderable financial loss. The individual cost of a container is of course low but the effect of the presence of a faulty container which requires even a brief stoppage of the plant, or at the very least of the filling unit, and then the implementation of a restarting procedure, leads to a substantial shortfall in the number of filled containers collected at the end of the line and therefore a loss of earnings which, in total, proves considerable.

Another disadvantage which affects the containers, whatever the type of plant, is the risk of contamination of the inside of containers which are displaced unsealed between the manufacturing unit and the filling unit and which remain unsealed for a period which may be very long in the case of intermediate storage of the finished containers between manufacturing and filling. To avoid the risks caused by such contamination, it is customary to provide a unit for rinsing the containers immediately upstream of the filling unit. Such a rinsing unit also proves to be costly to buy, to maintain and to use and it too requires space for its installation.

Document EP-A-0 427 683 describes an in-line bottling plant comprising essentially a unit for manufacturing containers, in particular bottles, made of thermoplastic material, a unit for filling said containers and, interposed between the outlet of said unit for manufacturing the containers and the inlet of said unit for filling the containers, a unit for conveying the containers which have just been manufactured, the unit for manufacturing the containers and the unit for filling the containers being arranged at as short as possible a distance from one another and the conveying unit being of short length and being arranged so as to displace the containers one after another without the containers being subjected to serious impacts, in particular against one another.

However, it will be observed that the short length of the conveying unit may lead to a difficulty for the cooling of the containers which have just been manufactured which leave the manufacturing unit still considerably hot. Until now, the cooling of the containers took place between the outlet of the manufacturing unit and their introduction into the filling unit, either by virtue of their intermediate storage or because of the size [sic] length of the intermediate conveyor. On the other hand, in the plant to which the invention relates, the short length required for the conveying unit means that there is a risk that the containers will be supplied still hot to the filling unit, which is not acceptable if the qualities of the filling liquid are to be preserved or for the mechanical resistance of the containers (deterioration, deformation etc.).

SUMMARY OF THE INVENTION

The aim of the invention is essentially to propose an improved arrangement which eliminates the abovementioned disadvantages while remaining compact, reliable and economical.

To these ends, a plant as mentioned above, when arranged according to the invention, is essentially characterized in that means of cooling at least a part, in particular at least the base (generally a thicker part which therefore cools less rapidly of course) of the containers leaving the manufacturing unit are associated with the conveying unit.

Making use of such cooling means, which may amount to no more than a simple blower, may not lead to any significant extra cost for installation or maintenance.

In a plant arranged in this way, the surface area occupied by the conveying unit is reduced considerably. Consequently, the cost of the constituent equipment of the conveying unit and the cost of setting up this plant are themselves also considerably reduced. In the same way, the malfunctioning risks of this conveying unit and the maintenance costs are lower. Generally, the installation and operating costs of the conveying unit are made that much lower, the shorter the distance separating the outlet of the unit for manufacturing the containers and the inlet of the filling unit.

The short transport distance for the containers furthermore makes it possible to arrange the conveyor in any desired manner. It is possible to retain a conveying structure with air jets which can then, given the short distance to cover, be adjusted so as to displace the containers at a speed corresponding to the operating speeds of the manufacturing unit and of the filling unit, and this speed is in any case considerably lower than that employed in the conveyors of great length currently used. Under these conditions, even if the containers collide, the impacts are not sufficiently violent to cause their deformation. One cause of malfunctioning of the filling unit is thus eliminated.

Also as a result of the short length of the conveying unit, the duration of the transfer of the containers from the outlet of the manufacturing unit to the inlet of the filling unit is short: the risk of internal contamination of the containers before their introduction into the filling unit is thus reduced considerably and it becomes possible to dispense with the machine for prior rinsing which was necessary until now. Once again, the result is a considerable saving in terms of equipment, space, washing liquid and maintenance, and therefore a considerable financial saving.

But the short transport distance also makes it possible to make use of, under acceptable installation and operating cost conditions, a mechanical conveyor capable of displacing the containers while keeping these at a predetermined spacing pitch, for example an endless-chain conveyor with grippers. It is then easy to arrange for the containers to be gripped at the outlet of the manufacturing unit and removed at a speed essentially identical to the speed at which the manufacturing unit delivers the finished containers, and it is similarly easy to arrange for the containers to arrive at the inlet of the filling unit at a speed essentially identical to the operating speed of the filling unit. It is therefore advantageous to provide synchronization means capable of synchronizing the respective operating speeds of the manufacturing unit, of the conveying unit and of the filling unit. It is also advantageous that the spacing pitches of the containers at the outlet of the manufacturing unit, during displacement in the conveying unit and at the inlet of the filling unit are essentially identical.

Although the short conveying length for the containers has numerous advantages as explained above, it nevertheless involves a risk of causing a disadvantage in the event of malfunctioning, even brief, of the filling unit (whether this is a problem affecting the filling unit itself or, more frequently, an incident occurring downstream of the latter, for example in the labeling station or in the packaging station). This is because the absence of temporary storage capacity for containers between the manufacturing unit and the filling unit would necessarily lead to the concomitant stoppage of the manufacturing unit. This would result in the loss of containers in the course of manufacture which would be held up in the heating furnaces and which would be irretrievably lost as a result of the fact that the constituent thermoplastic material would undergo uncontrolled overheating during treatment. The financial loss due to the destruction of the containers contained at the same time in the manufacturing unit (which may amount to several hundred units in the largest plants) is not inconsiderable and must therefore be avoided. Above all, this would also result in a deterioration of certain components or certain parts of the heating means, or even damage to them, which has to be avoided at all costs.

It is therefore desirable that the plant is arranged in such a manner that, during a stoppage of the filling unit, the manufacturing unit can continue to operate temporarily so that, before the manufacturing unit is itself stopped, the heating furnace (or furnaces) is emptied so as to avoid said disadvantages and/or that a reserve of finished containers is constituted so as to facilitate putting the plant back into operation, as explained below.

To this end, provision is made that the plant according to the invention can also comprise a unit for temporarily retaining containers which is selectively connectable to the conveying unit and which is arranged so as to receive and retain a certain number of containers. It is then important that the retaining unit is itself arranged so that the displacement of the containers one after another takes place without said containers being subjected to serious impacts.

So as to avoid, as mentioned above, any risk of damage to the heating furnace(s) and a significant loss of containers, provision can then advantageously be made that:

if the manufacturing unit comprises at least one furnace for heating preforms situated upstream of a device for molding hot preforms, then the retaining capacity of the retaining unit is approximately equal to the number of containers present at the same time in the heating furnace, so that, in the event of stoppage of the filling unit, the manufacturing unit can be kept in operation until the heating furnace has been emptied, if the manufacturing unit comprises a number of heating furnaces situated upstream of respective molding devices, then the retaining capacity of the retaining means is approximately equal to the number of containers present at the same time in the manufacturing unit between the inlet of the first furnace and the outlet of the final furnace, so that, in the event of stoppage of the filling unit, the manufacturing unit can be kept in operation until all the heating furnaces have been emptied.

In either case, it is also possible to envisage the retaining capacity of the retaining means being approximately equal to the number of containers present at the same time in the whole of the manufacturing unit, so that, in the event of stoppage of the filling unit, the manufacturing unit can be kept in operation until it has been entirely emptied.

In combination with or independently of the above, the presence of a unit for retaining containers within the plant may also be desirable so as to facilitate putting the plant in operation. This is because, when the plant has been stopped for only a brief period of time, for example because of a minor incident, the heating furnace(s) of the manufacturing unit have not had the time to cool down appreciably and the unit for manufacturing containers can then restart essentially instantaneously, at the same time as the filling unit. On the other hand, after a stoppage of relatively long or very long duration, the heating furnace has cooled down appreciably and provision has to be made for a preheating time before the manufacturing unit is capable of producing finished containers again, while the filling unit for its part is ready to operate immediately.

In this context, it is therefore important to introduce the unit for retaining containers and to make provision that the capacity of the latter is at least equal to the number of containers necessary for the operation of the filling unit, when the plant is put back into operation, for a period of time necessary for putting the manufacturing unit into operation (reheating time).

In a preferred embodiment, the retaining unit comprises a conveyor in an open loop which is selectively connectable via its inlet end and/or via its outlet end to the conveying unit and having a length which renders it suitable to receive said containers arranged one after another. A retaining unit thus arranged can be sufficiently compact so as not to involve excessive extra cost.

The selective connection of said conveyor to the conveying unit can be performed with the aid of points means interposed between the conveying unit and the inlet end of the retaining unit and between the conveying unit and the outlet end of the retaining unit. As these points means are not operationally active when they are switched from one position to the other—that is to say they are not then capable of carrying out the guidance, to the appropriate destination, of the containers which would arrive during this switching time—provision can advantageously be made, so as to avoid any malfunctioning, that the containers arriving during this switching time are ejected from the circuit with the aid of means of ejecting containers, associated with said points means.

Ejecting and/or stopping means can also be provided upstream of the furnace(s) so as to eject and/or stop the containers (preforms or intermediate containers) which are supplied to the furnace(s) while the filling unit is no longer in operation. Continuing to feed the manufacturing unit at the moment when the latter is going to be stopped itself, during the phase of emptying the furnace(s) following a stoppage of the filling unit, is thus avoided.

In conclusion, a plant arranged according to the invention eliminates, by its very compactness, the numerous disadvantages of previous plants and proves to be of particular importance on the financial level as far as the equipment utilized, its installation, its operation and its maintenance are concerned.

BRIEF DESCRIPTION OF THE FIGURES

The invention will be better understood on reading the detailed description below of a number of embodiments given only by way of in no way limiting examples. In this description, reference is made to the attached drawings, in which.

DETAILED DESCRIPTION OF THE PREFERRED EMBODIMENT

Figure 1:
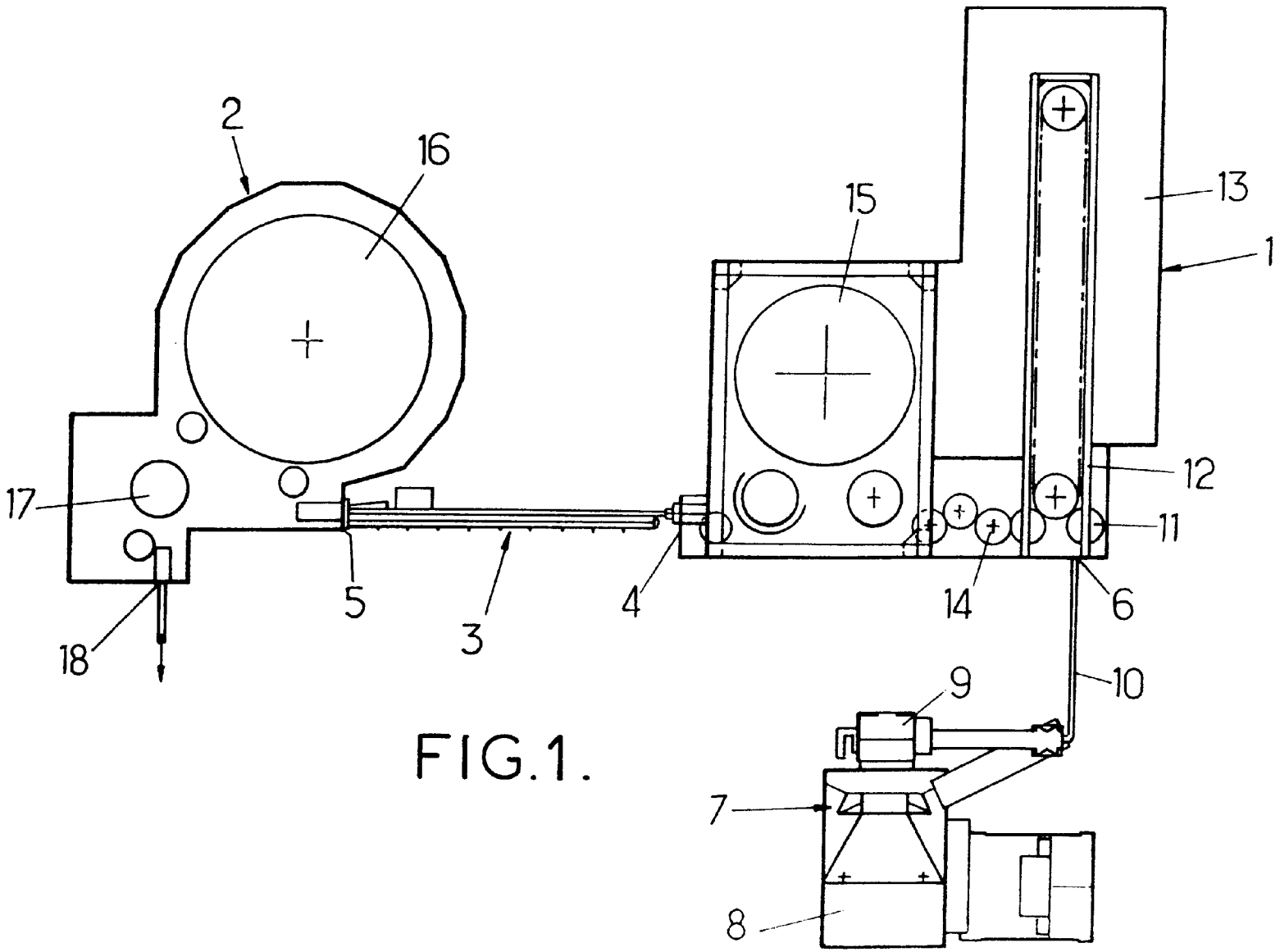
FIG. 1 illustrates in a very diagrammatic manner a plant structure arranged according to the invention.

The plant shown in FIG. 1 comprises essentially a unit 1 for manufacturing containers, such as bottles, made of thermoplastic material, a unit 2 for filling said containers, and a unit 3 for conveying the manufactured containers from the outlet 4 of the manufacturing unit 1 to the inlet 5 of the filling unit.

The manufacturing unit 1 may be of any appropriate type for the manufacture of containers, such as bottles, made of thermoplastic material such as polyethylene terephthalate PET, polyethylene naphthalate PEN or others. At its inlet, it receives preforms made of amorphous material originating from a preform feed unit 7. The unit 7 may consist of a hopper 8 which receives in bulk preforms manufactured by molding in advance and in another location, which hopper is connected to the inlet 6 via a sorter 9 which separates and positions the preforms on a slide 10 connected to the inlet 6 of the manufacturing unit (cold preform feed) as shown in FIG. 1. The unit 7 may also comprise the unit for molding the preforms itself which delivers the preforms which have just been molded and are still hot directly to the inlet 6 of the manufacturing unit (hot preform feed).

Treatment of the preforms within the manufacturing unit may be of any type and adapted to the type of containers to be produced (single or double blow molding, single or multiple heat treatment etc.). FIG. 1, for reasons of simplicity and clarity, shows a single treatment of the preforms which are mounted at 11 on a transfer line 12, then heated as they file through a tunnel furnace 13 before being taken back at 14 to be introduced hot into a blowing or drawing/blowing device 15 with multiple molds arranged on a carousel. After controlled cooling, the containers which have just been manufactured, arrive at the outlet 4 of the manufacturing unit 1.

The containers received at the inlet 5 of the filling unit 2 are arranged on a filling device with a rotating drum 16 from where, once filled, they are extracted and delivered to a sealing device 17. The filled-and sealed containers are then removed via the outlet 18 of the filling unit 2 to a labeling station and then a packing station (not shown).

The container manufacturing unit 1 and the filling unit 2 are arranged as close as possible to one another in such a manner that the distance between the outlet 4 of the former and the inlet 5 of the latter is as short as possible. The conveying unit 3 which extends from said outlet 4 to said inlet 5 is therefore short and introduction of the containers from the conveying unit 3 into the filling unit 2 takes place directly, without passing via a washing device which has been rendered superfluous because the risk of internal contamination of the containers has now been greatly reduced. Given its short length, the conveying unit 3 may of course be of the type with jets of air like the conveyor devices of very great length used in current plants but it may also be made under economically acceptable conditions in the form of an endless-chain conveyor device with grippers, for example, which is capable of transporting the containers with a constant spacing pitch.

The operating speed of the conveying unit 3 may easily be adjusted corresponding to the speed of delivery of the containers at the outlet 4 of the manufacturing unit 1 to [sic] the speed of admission of the containers at the inlet 5 of the filling unit. It will be noted here that improvements may be made to the filling units which give them a filling capacity which has become of the same order of magnitude as the manufacturing capacity of the blowing units. A filling unit can thus currently be fed with containers to be filled from a single container manufacturing unit which means that a single conveying unit is to be provided to connect one to the other. This thus results in a considerable simplification of the general design of the plant and greater compactness for a given production rate.

In this respect, it will also be noted that the means made use of in a plant according to the invention lead to a lower risk of malfunctioning and therefore allow very high production speeds. The invention therefore finds a preferred area of application in plants which are capable of producing and filling several tens of thousands of containers per hour.

Given the identical orders of magnitude of the operating speeds of the container manufacturing unit 1 and the filling unit 2, it is possible to provide for synchronization of operation of these two units and furthermore of the operation of the conveying unit 3 in such a manner that the flow of containers leaving the manufacturing unit coincides perfectly with the flow of containers admitted into the filling unit, which avoids any container compensation phenomenon during transfer. In this way, a cause of damage to the containers and therefore a cause of incident and possible stoppage of the filling unit is eliminated.

Figure 2:
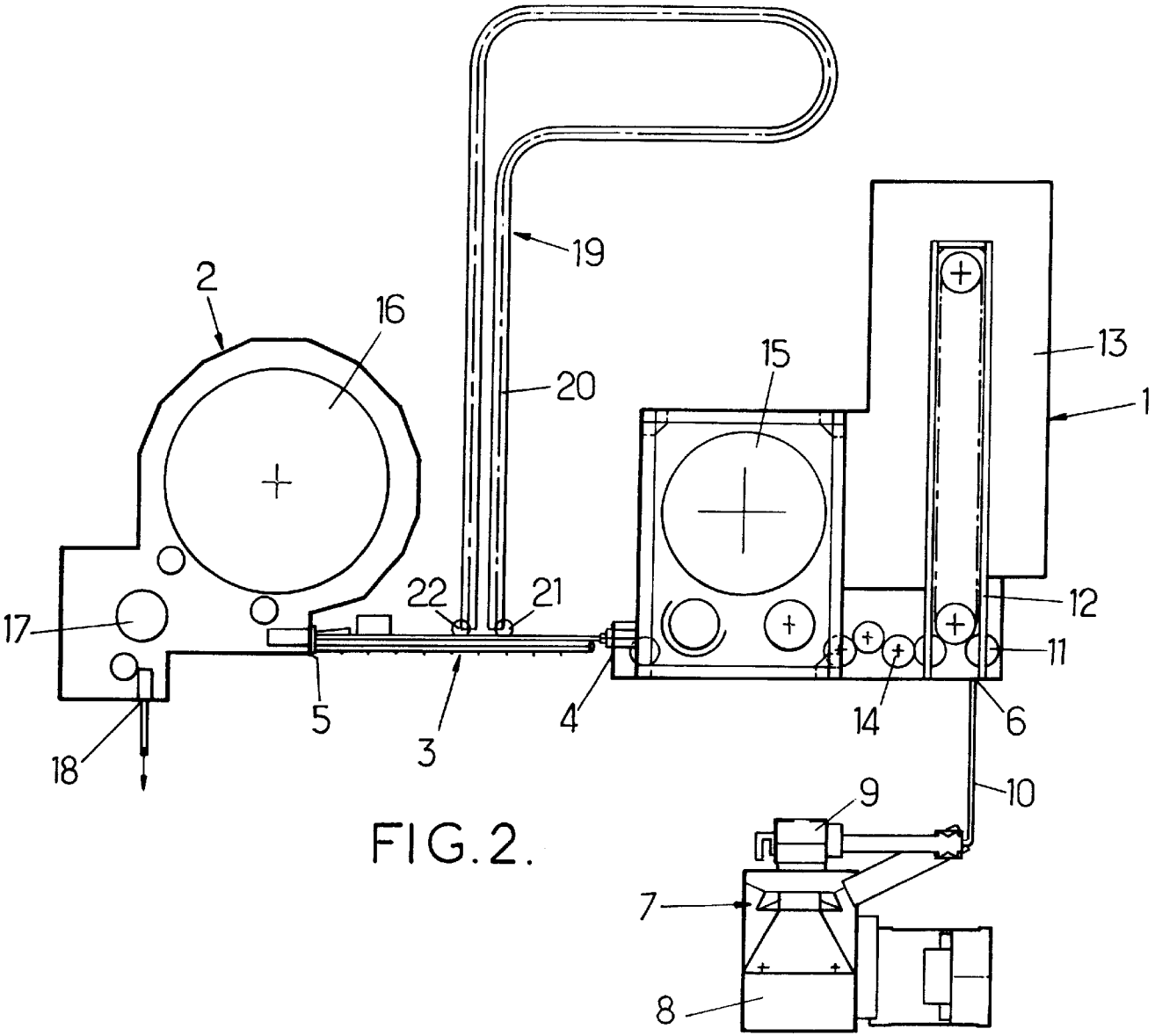
FIG. 2 illustrates another embodiment in which the plant in FIG. 1 is supplemented by a unit for retaining containers.

Preferably, as shown in FIG. 2, provision is made to add to the conveying unit 3 a temporary retaining unit 19 which is arranged to receive, temporarily retain and return a certain number of containers. It is desirable that the retaining unit itself also be arranged so that the displacement of the containers one after the other takes place without said containers being subjected to serious impacts.

In order to avoid the loss of corresponding containers overheated while remaining immobile in front of the heating means, and in order also to avoid deterioration of or even damage to said heating means, it is desirable that the manufacturing unit continues to operate after a stoppage of the filling unit so as to finish, at least, one ongoing heating cycle. In this way, when the manufacturing unit comprises at least one furnace for heating preforms situated upstream of a device for molding hot preforms, provision is made that the retaining capacity of the retaining unit is approximately equal to the number of containers present at the same time in the heating furnace, so that, in the event of stoppage of the filling unit, the manufacturing unit can be kept in operation until the heating furnace has been emptied. Similarly, when the manufacturing unit comprises a number of heating furnaces situated upstream of respective molding devices, provision is made that the retaining capacity of the retaining unit is approximately equal to the number of containers present at the same time in the manufacturing unit between the inlet of the first furnace and the outlet of the final furnace, so that, in the event of stoppage of the filling unit, the manufacturing unit can be kept in operation until all the heating furnaces have been emptied.

Furthermore, in particular in a case in which the manufacturing unit is employing a multiple molding process, for example a double blowing and/or drawing/blowing process, involving a number of heating phases, it is then simpler to provide for the manufacturing unit to be completely emptied of all the containers in the course of treatment which are present there at the same time at the moment when the filling unit stops: the retaining unit must then be arranged so as to be capable of accepting this number of containers, which may prove to be relatively high. To give an idea, a large-capacity manufacturing unit contains in the region of 500 containers undergoing treatment at various stages; if the body of a finished container has a diameter of the order of 10 cm, a line of these containers placed next to one another has a length of about 50 meters. It will therefore be necessary to provide a retaining unit having a length of the order of 50 to 60 meters, which, from the point of view of size, corresponds to a developed length ten times shorter than that of the conveying means serving as a buffer used in previous plants.

The retaining unit 19 may comprise a conveyor 20 extending in an open loop between an inlet 21 and an outlet 22 which can be selectively switched to the conveying unit 3. The open loop formed by the conveyor 20 has a developed length capable of receiving said number of containers, which may amount to several hundred in the largest manufacturing units. Under these conditions, in the event of stoppage of the filling unit 2, it is possible to finish emptying the manufacturing unit 1 (by interrupting its feed of preforms) in such a manner that all containers in the course of manufacture, which are present in the manufacturing unit 1 at the moment the filling unit 2 stops, can be recovered finished and ready to be used as soon as the plant is put back into operation. In this way, wasting a not inconsiderable number of containers is avoided, and in particular clogging of or even damage to the manufacturing unit is avoided, which could occur in the event of stoppage of the latter while still full of containers in the course of manufacture.

Furthermore, following too long a stoppage, which leads to the cooling of the heating means, the manufacturing unit can start to produce containers again only after a preheating period. In order to dispense with the disadvantage of such a delay as far as the filling unit is concerned, which itself can be put back into operation instantaneously, it is possible to make provision that the retaining unit has sufficient capacity to be capable of feeding the filling unit, first to be put back in operation, while waiting for the end of preheating.

To carry out the passage of the containers from the conveying unit 3 onto the retaining unit 19 and vice versa, provision is made to arrange points means between the conveying unit 3 and the inlet end 21 of the retaining unit 19 and/or between the conveying unit 3 and the outlet end 22 of the retaining unit 19. However, these points means have a response time and are not capable of guiding the containers in a reliable manner during their switching phase. So as to avoid any incident in the event of containers arriving during this switching phase, provision is made, as shown in FIG. 3, to associate means of ejecting containers with these points means, at least with those situated at the inlet 21 of the retaining unit as indicated as 23 in FIG. 3, so that the containers arriving during the switching phase are ejected.

Figure 3:
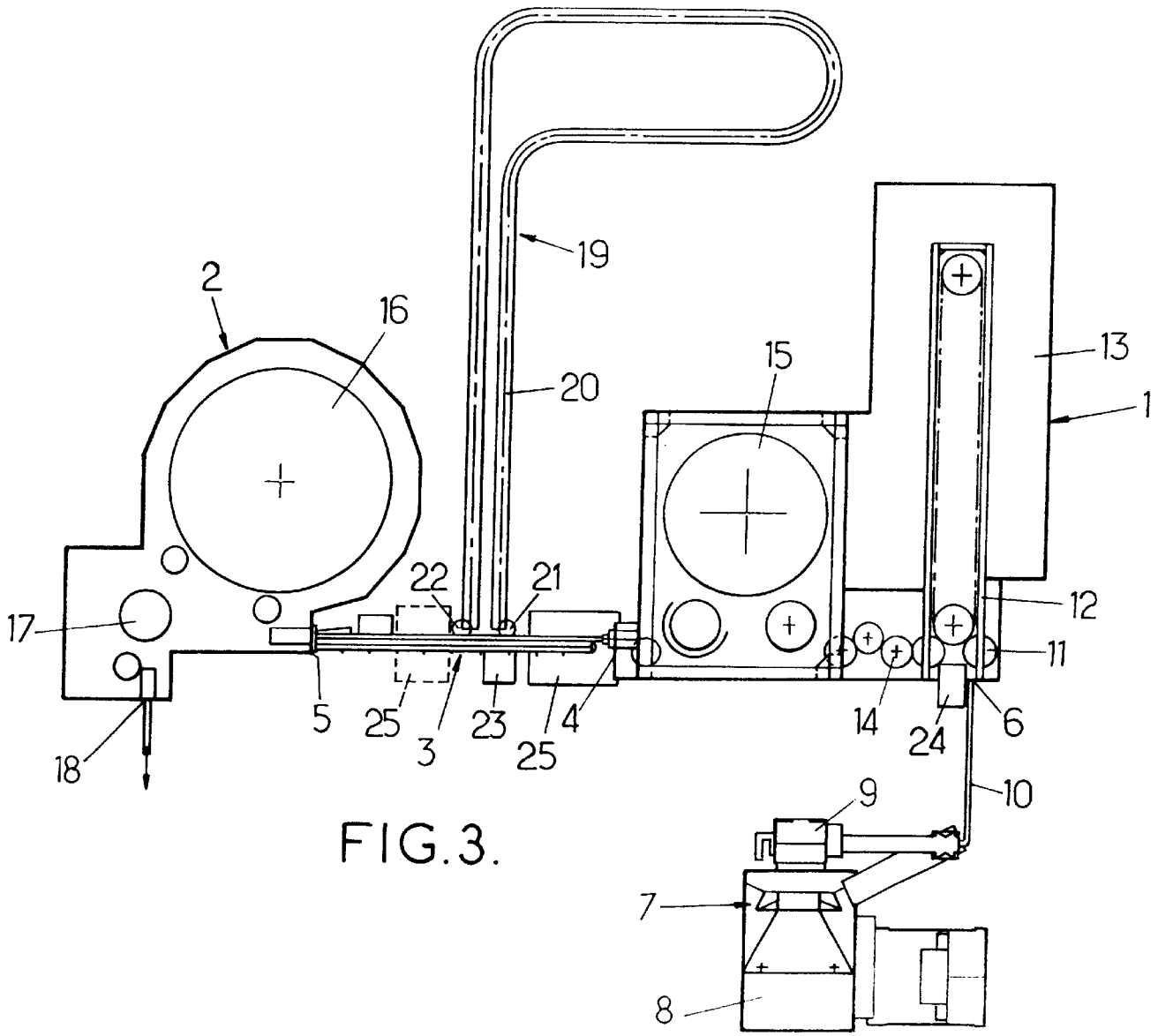
FIG. 3 illustrates another embodiment in which the plant in FIG. 2 is supplemented by a number of additional devices.

In the same way, it may be advantageous to arrange ejecting means or stopping means (for example a block across the supply corridor), designated at 24 in FIG. 3, upstream of the heating furnace(s) of the manufacturing unit, so as to eject or stop the containers (preforms, intermediate containers) which are supplied to the furnace(s) while the filling unit is no longer in operation. As the manufacturing unit is then still being kept in service so as to finish the containers in the course of manufacture as specified above, it is in this way ensured that no new preform or intermediate container is introduced into the furnace(s).

Finally, in order that the containers (which leave the manufacturing unit still hot) are introduced cold into the filling unit in spite of the length of the conveying unit 3 being as short as possible, means 25 of cooling all or part, and in particular the bottom, of the containers leaving the manufacturing unit are associated with the conveying unit. The cooling means 25 may be situated at the outlet of the manufacturing unit, or even extend as far as the inlet of the filling unit if necessary. These cooling means may be made in any appropriate manner, from a simple, inexpensive blower transverse to the conveyor, to tunnel-type equipment with blowing of cold air or of a cold gas in counter-current to the circulation of the containers, which is more effective but more expensive.

As is obvious and as already emerges from the above, the invention is in no way limited to those embodiments of it which have been more specifically envisaged; it includes, on the other hand, all the variants.

I claim:

1. An in-line bottling plant, comprising:

a unit (1) for manufacturing containers made of thermoplastic material, said unit for manufacturing containers having an outlet (4);

a unit (2) for filling containers manufactured by said unit for manufacturing containers, said unit for filling containers having an inlet (5); and a unit (3) for conveying the containers which have just been manufactured, said unit for conveying containers interposed between said outlet of said unit for manufacturing containers and said inlet of said unit for filling containers, said unit for conveying containers being arranged so as to displace the containers just manufactured one after another without the containers being subjected to damaging impacts; and means (25) for cooling at least a part of the containers leaving said unit for manufacturing containers, said means for cooling being operated with said conveying unit.

2. The in-line bottling plant according to claim 1, wherein said cooling means (25) is arranged so as to cool at least a bottom of the containers.

3. The in-line bottling plant according to claim 1, wherein said conveying unit (3) is arranged so as to displace the containers while keeping the containers at a predetermined distance from one another.

4. The in-line bottling plant according to claim 1, further comprising means for synchronizing respective operating speeds of said manufacturing unit (1), of said conveying unit (3) and of said filling unit (2).

5. The in-line bottling plant according claim 1, wherein spacing pitches of the containers at the outlet (4) of the manufacturing unit (1), during displacement in the conveying unit (3), and at the inlet (5) of the filling unit (2), are substantially identical.

6. The in-line bottling plant according to claim 1, further comprising a unit (19) for temporarily retaining containers and which is selectively connectable to said conveying unit (3) and which is arranged so as to receive and retain a certain number of containers.

7. The in-line bottling plant according to claim 6, wherein said retaining unit (19) is also arranged so that a displacement of the containers one after another takes place without the containers being subjected to damaging impacts.

8. The in-line bottling plant according to claim 6, in which the manufacturing unit comprises at least one furnace for heating preforms situated upstream of a device for molding hot preforms, wherein a retaining capacity of said retaining unit is approximately equal to a number of containers present at a same time in said heating furnace, so that, in an event of stoppage of said filling unit, said manufacturing unit is kept in operation until said heating furnace has been emptied.

9. The in-line bottling plant according to claim 6, in which said manufacturing unit comprises a number of heating furnaces situated upstream of respective molding devices, wherein a retaining capacity of the retaining unit is approximately equal to a number of containers present at a same time in said manufacturing unit between an inlet of a first furnace of said number of heating furnaces and an outlet of a final furnace of said number of heating furnaces, so that, in an event of stoppage of said filling unit, said manufacturing unit can be kept in operation until all said heating furnaces have been emptied.

10. The in-line bottling plant according to claim 6, wherein a retaining capacity of said retaining unit is approximately equal to a number of containers present at a same time in said manufacturing unit, so that, in an event of stoppage of said filling unit, said manufacturing unit can be kept in operation until said manufacturing unit has been emptied.

11. The in-line bottling plant according to claims 6, wherein a retaining capacity of said retaining unit is at least equal to a number of containers necessary for an operation of said filling unit, when said plant is put back into operation, for a period of reheating time necessary for putting said manufacturing unit into operation.

12. The in-line bottling plant according to claims 6, wherein said retaining unit (19) comprises a conveyor (20) in an open loop which is selectively connectable via at least one of an inlet end (21) and an outlet end (22) of said conveyor to said conveying unit and having a length which allows said conveyor to receive the containers arranged one after another.

13. The in-line bottling plant according to claim 12, further comprising points means interposed between at least one of said conveying unit and the inlet end of the retaining unit and said conveying unit and the outlet end of the retaining unit, and ejecting means (23) associated with said points means arranged so as to eject the containers which arrive at said points means during a change in position of the latter.

14. The in-line bottling plant according to claims 8, further comprising ejecting and/or stopping means (24) situated upstream of said at least one furnace so as to eject and/or stop preforms which are supplied to said furnace while said filling unit is no longer in operation.

15. The in-line bottling plant according to claim 1, wherein the containers are bottles.

16. The in-line bottling plant according to claim 1, wherein said unit for conveying containers which have just been manufactured is arranged so as to displace the containers one after another without the containers being subjected to damaging impacts one against the other.

* * * * *